US007013983B2

(12) United States Patent
Matsumoto et al.

(10) Patent No.: US 7,013,983 B2
(45) Date of Patent: Mar. 21, 2006

(54) BLADE MOUNTING STRUCTURE OF BULLDOZER

(75) Inventors: Norihisa Matsumoto, Hirakata (JP); Tatsuo Wada, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/719,325

(22) Filed: Nov. 20, 2003

(65) Prior Publication Data

US 2005/0000710 A1 Jan. 6, 2005

(30) Foreign Application Priority Data

Jun. 18, 2003 (JP) ..... 2003-173272

(51) Int. Cl.
*E02F 3/76* (2006.01)

(52) U.S. Cl. ..... 172/824; 172/811

(58) Field of Classification Search ..... 172/810, 172/811, 818, 819, 820, 821, 822, 823, 824, 172/826, 828
See application file for complete search history.

(56) References Cited

U.S. PATENT DOCUMENTS

| | | | | |
|---|---|---|---|---|
| 3,395,764 | A * | 8/1968 | Wirt | 172/826 |
| 3,441,092 | A * | 4/1969 | Drone | 172/826 |
| 3,503,457 | A * | 3/1970 | Land et al. | 172/826 |
| 3,656,558 | A * | 4/1972 | Kolinger | 172/826 |
| 3,661,215 | A * | 5/1972 | Pensa | 172/812 |
| 3,974,881 | A | 8/1976 | Terai et al. | |
| 4,013,132 | A * | 3/1977 | Matsuzawa | 172/821 |
| 4,019,588 | A | 4/1977 | Casey | |
| 4,221,267 | A * | 9/1980 | Asal et al. | 172/821 |
| 4,306,625 | A * | 12/1981 | Davis | 172/819 |
| 5,058,685 | A * | 10/1991 | Moffitt | 172/820 |
| 5,477,600 | A * | 12/1995 | Houle et al. | 37/279 |
| 5,634,523 | A | 6/1997 | Kobayashi et al. | |
| 6,105,682 | A * | 8/2000 | Recker et al. | 172/811 |
| 6,109,363 | A * | 8/2000 | High | 172/820 |
| 6,129,155 | A * | 10/2000 | Lombardi | 172/2 |

FOREIGN PATENT DOCUMENTS

| | | |
|---|---|---|
| AU | 227859 | 11/1958 |
| JP | 63-136043 | 9/1988 |
| JP | 64-14251 | 1/1989 |
| JP | 5-42066 U | 6/1993 |
| JP | 06-248663 | 9/1994 |
| JP | 06-248664 | 9/1994 |
| JP | 2546933 Y2 | 5/1997 |
| JP | 2002-097658 A | 4/2002 |
| SU | 543702 | 5/1975 |
| SU | 1481346 A1 | 9/1987 |

* cited by examiner

*Primary Examiner*—Victor Batson
(74) *Attorney, Agent, or Firm*—Frishauf, Holtz, Goodman & Chick, P.C.

(57) ABSTRACT

A blade mounting structure of a bulldozer capable of increasing visibility of a blade is provided. For this purpose, in the blade mounting structure in which a left and a right portions of a blade (1) and a vehicle main body are connected with a set of left and right straight frames (3, 3) to be swingable up and down and to a left and a right, and the straight frames and the blade are respectively connected by a hydraulic cylinder (4) for tilt drive and a support member (4*a*) to be swingable up and down and to the left and the right to be constituted to be capable of tilt drive, the blade mounting structure includes an arm (2) for connecting only any one of the straight frames and a substantially central portion of the blade to be swingable up and down and to the left and the right.

12 Claims, 7 Drawing Sheets

BLADE MOUNTING STRUCTURE OF BULLDOZER

TECHNICAL FIELD

The present invention relates to a blade mounting structure of a bulldozer which is capable of tilt.

BACKGROUND ART

In a blade of a bulldozer, a structure as shown in, for example, FIG. 8 is conventionally known as a blade mounting structure for inclining (hereinafter, called tilt) the blade in a left and right direction. In FIG. 8, tip end portions of a set of left and right straight frames 3 and 3 are connected to lower portions of left and right end portions of a blade 1 via connecting members J1L and J1R such as ball joints or cross joints (joints each having a pin turning in an up-and-down direction and a pin turning in a left and right direction) to be swingable up and down and to a left and a right. Base end portions of the set of left and right straight frames 3 and 3 are connected to left and right portions of a set of left and right traveling unit frames 6 at a side of a bulldozer vehicle body via ball joints J2L and J2R respectively to be swingable up an down and to the left and the right. A hydraulic cylinder 4 for tilt drive is connected to either a left or a right side (in FIG. 8, the right side facing to the front side of the vehicle) and a support member 4*a* is connected to the other side, between upper portions of the left and right end portions of the blade 1 and the set of left and right straight frames 3 and 3. The hydraulic cylinder 4 and the support member 4*a* are respectively connected with ball joints J4R and J4L on a side of the blade 1, and with pin connection J5R and J5L swingably in vertical surfaces on sides of the straight frames 3. One end portion of a link member 5 is connected to a central portion of the lower portion of the blade 1 with a pin swingably up and down. Arms 2 and 2 are connected to between the set of left and right straight frames 3 and 3 and the other end portion of the link member 5 respectively via ball joints J3C, J3L and J3R (for example, see page 2, and FIG. 1 and FIG. 2 of Japanese Utility Model No. 2546933).

As the other mounting structure example of the arms 2 and 2, there is the one provided with two arms 2*a* and 2*a* swingably mounted instead of the link 5, as shown in FIG. 9. Namely, one end portions of a set of left and right arms 2*a* and 2*a* are connected to the end portions of the set of left and right straight frames 3 and 3 on the side of the blade via ball joints J6L and J6R swingaly up and down and to the left and the right. The other end portions of the arms 2*a* and 2*a* are swingably connected to each other via a ball joint J7. The arms 2 and 2 are swingably connected to the other end portions of the set of left and right arms 2*a* and 2*a* via ball joints J8 and J8.

However, in the above-described conventional blade mounting structure, the following problems exist. The set of left and right arms 2 and 2, or the sets of left and right arms 2 and 2, and 2*a* and 2*a* are mounted to a rear side of the lower portion of the blade 1. However, a predetermined clearance (corresponding to a clearance d shown in FIG. 9) is needed to avoid interference between the set of left and right arms 2 and 2 and a front portion of the vehicle main body, and therefore the position of the blade 1 has to be located away from the vehicle body. In addition, the set of left and right arms 2 and 2, or the set of left and right arms 2 and 2, and 2*a* and 2*a* are connected to the blade 1. Consequently, it becomes difficult to secure visibility of the blade 1 from a driver's cab 7 provided at the vehicle body (especially, the visibility of a left portion of the blade from the driver's cab 7 which is normally provided to be set aside on a left side of the vehicle body), and there arises the problem that favorable workability is not provided at the time of a ground leveling operation and the like by the blade 1.

Since the number of arms 2, 2, 2*a* and 2*a* is large, the number of welded spots of the ball joints and the like which are their connecting members is large, thus causing the problem that the entire weight of the blade is increased by welding for securing the base material strength and the welding operation time is required to increase the manufacturing cost. Further, there are many spots to be supplied with grease such as ball joints, and therefore there exists the problem of reduction in maintainability.

SUMMARY OF THE INVENTION

The present invention is made in view of the above-described problems, and has its object to provide a blade mounting structure of a bulldozer capable of increasing visibility of a blade and reducing entire weight of the blade and manufacturing cost.

In order to attain the above-described object, a blade mounting structure of a bulldozer according to the present invention: in the blade mounting structure of a bulldozer in which a left and a right portions of a blade and a vehicle main body are connected with a set of left and right straight frames to be swingable up and down and to a left and a right, and the set of left and right straight frames and the blade are respectively connected by a hydraulic cylinder for tilt drive and a support member or by a set of left and right hydraulic cylinders for tilt drive to be swingable up and down and to the left and the right to be constituted to be capable of tilt drive; includes an arm for connecting only any one of the set of left and right straight frames and a substantially central portion of the blade to be swingable up and down and to the left and the right.

According to the above constitution, only any one of the set of left and right straight frames and the substantially central portion of the blade are connected with the arm to be swingable up and down and to the left and the right, and the load in the left and right direction exerted on the blade is supported by only the arm at the one side, whereby the attitude of the blade can be held. Further, this structure makes it possible to tilt-drive the blade following the extension and contraction of the hydraulic cylinder for tilt drive. Consequently, the link member is not needed between the blade and the arm, and the blade position is located near to the vehicle body by the space for the link member, thus making it possible to enhance the driving performance of the blade, and improving the weight balance of the entire bulldozer to make it possible to enhance traveling performance. In addition, the distance between the blade and the vehicle body is shortened, and therefore visibility of the blade becomes favorable.

Since the blade is provided to be close to the arm, the area in which visibility of the blade is hindered by the arm is reduced, and visibility of the blade can be increased. Further, since the arm is provided at only any one of the left and the right sides, visibility of the blade end portion opposite to the arm mounted side can be increased, and blade operability can be enhanced. Since the number of the arm is only one, the number of welded spots of the arm connecting member is reduced, and the rigidity distribution of the blade can be concentrated on the arm mounted side. Consequently, the weight of the entire blade can be reduced, the manufacturing cost can be reduced and the grease supplying operation for the connecting portions can be facilitated.

In the blade mounting structure of a bulldozer: a connection point of the arm and the blade may be provided at an upper portion from a line connecting connection points of the set of left and right straight frames and the blade. According to this constitution, the left and right tilt amounts of the blade can be equalized, and therefore operability of the blade at the time of tilt can be enhanced, thus making it possible to enlarge the application range of this bulldozer. There is no fear that the arm interferes with the ground, rocks and stones, or the like during operation of the blade, and therefore favorable operability of the blade is provided.

In the blade mounting structure of a bulldozer: length of the arm may be variable. According to this constitution, the arm length is made variable, and therefore it becomes possible to off-set the blade to the left and the right with respect to the center of the vehicle body in the longitudinal direction, and to use the bulldozer as an angledozer by inclining the blade to the left and right direction, thus making it possible to enlarge the application range of this bulldozer.

BEST MODE FOR CARRYING OUT THE INVENTION

A preferred embodiment of the present invention will be explained in detail below with reference to the drawings.

Figure 1:
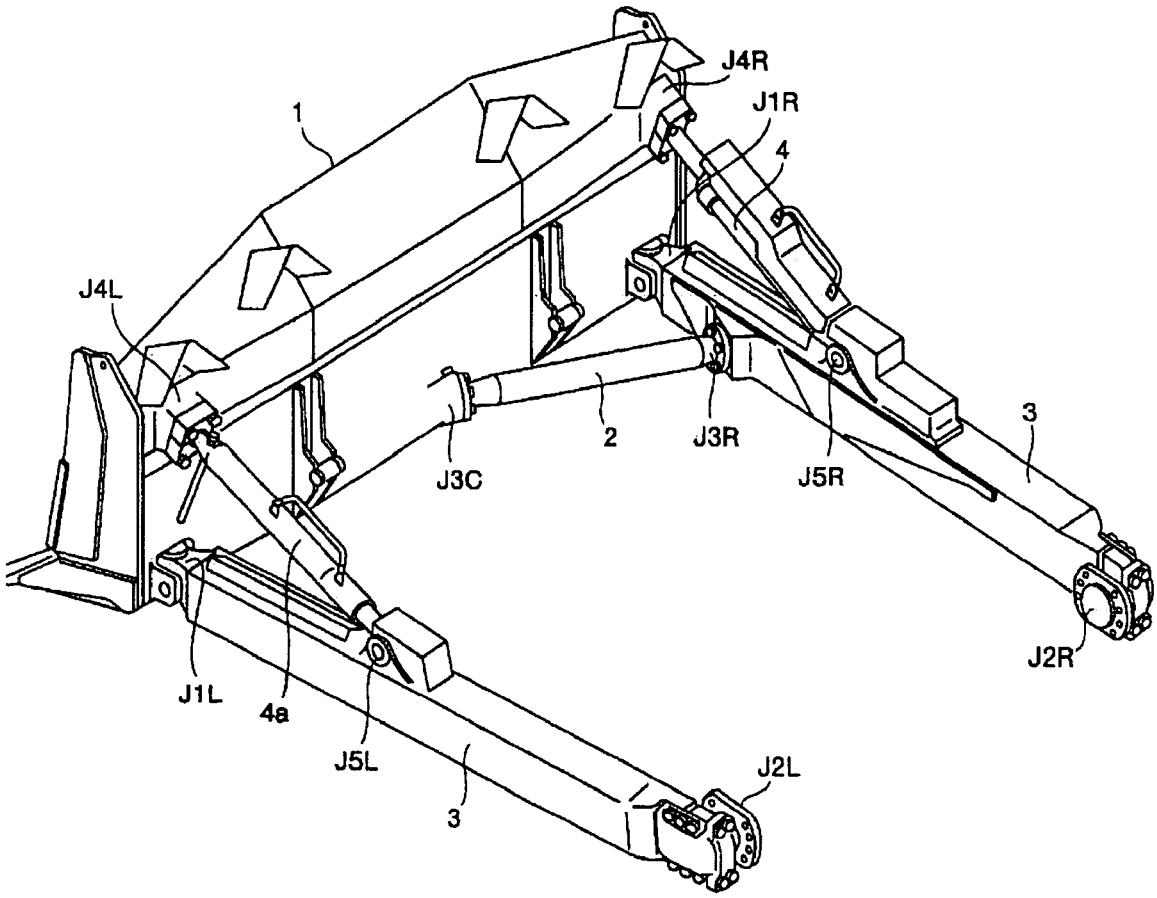
FIG. 1 is a perspective view of a mounting structure of a blade according to an embodiment of the present invention.
Figure 8:
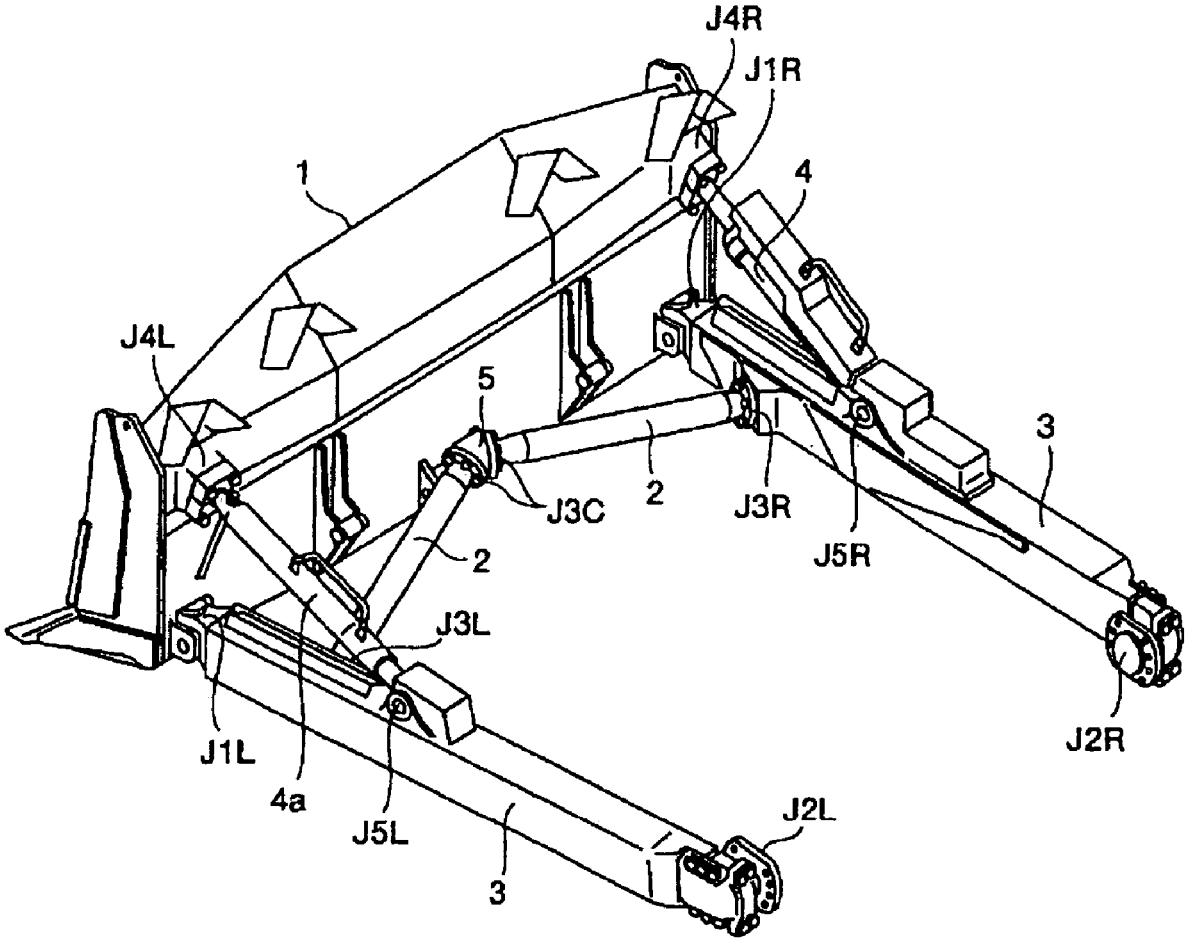
F I G. 8 Prior Art
FIG. 8 is a perspective view showing a blade mounting structure capable of tilt of a prior art.
Figure 9:
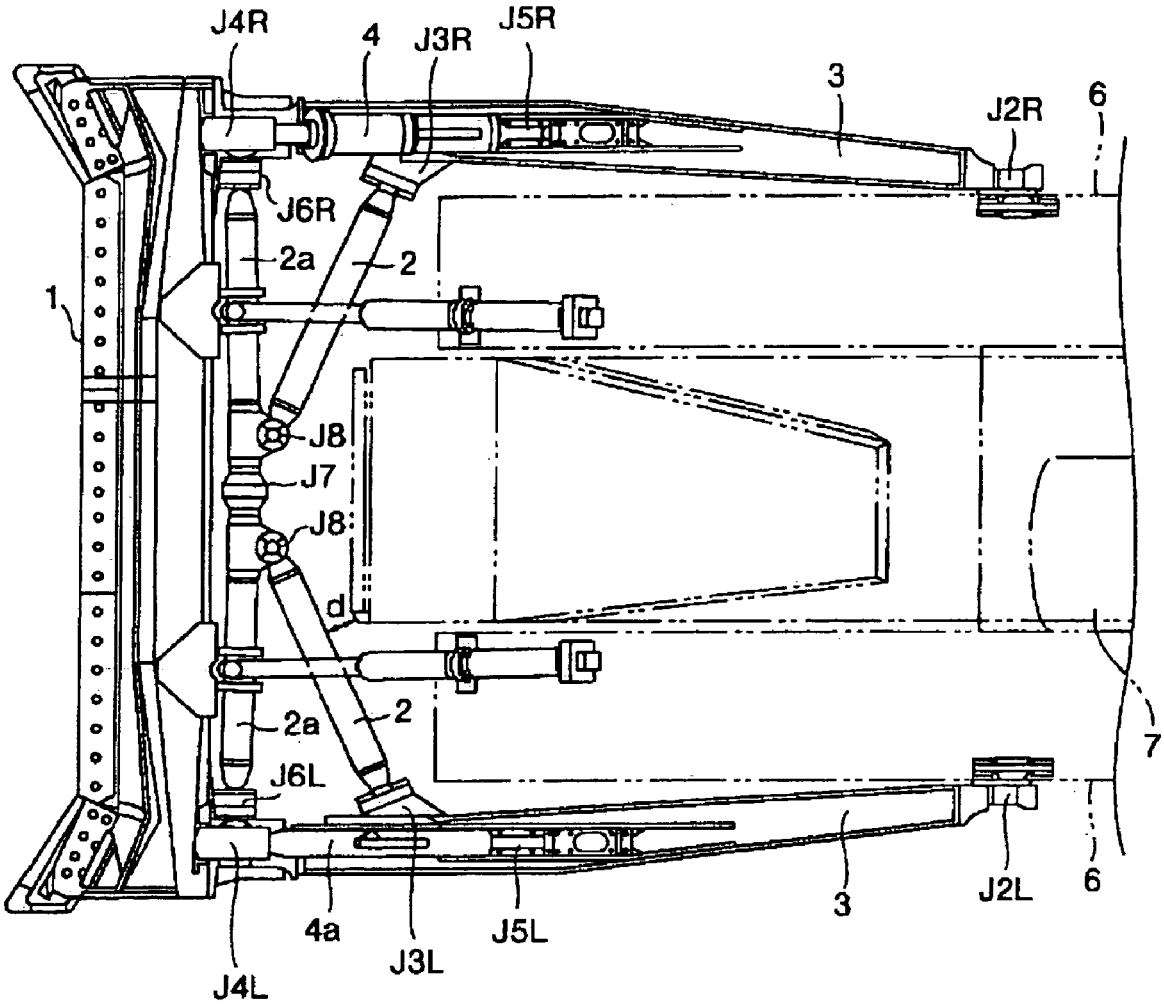
F I G. 9 Prior Art
FIG. 9 is a plan view showing another blade mounting structure capable of tilt of the prior art.

FIG. 1 is a perspective view of a mounting structure of a blade according to the embodiment. In the below, components having substantially the same functions as the components shown in FIG. 8 are given the same reference numerals and symbols and explanation thereof will be omitted. An arm 2 is connected to a substantially central lower portion of the blade 1 and a straight frame 3 via ball joints J3C and J3R at only either one of left or right side. When a driver's cab 7 (see FIG. 9) is provided on a left side of a vehicle body, it is preferable to provide the one arm 2 at a right side of the blade 1 to enhance visibility from the driver's cab 7. Rigidity of the blade 1 against an external force in a left and right direction is secured by the one arm 2. The ball joint J3R may be a pin joint.

Figure 2:
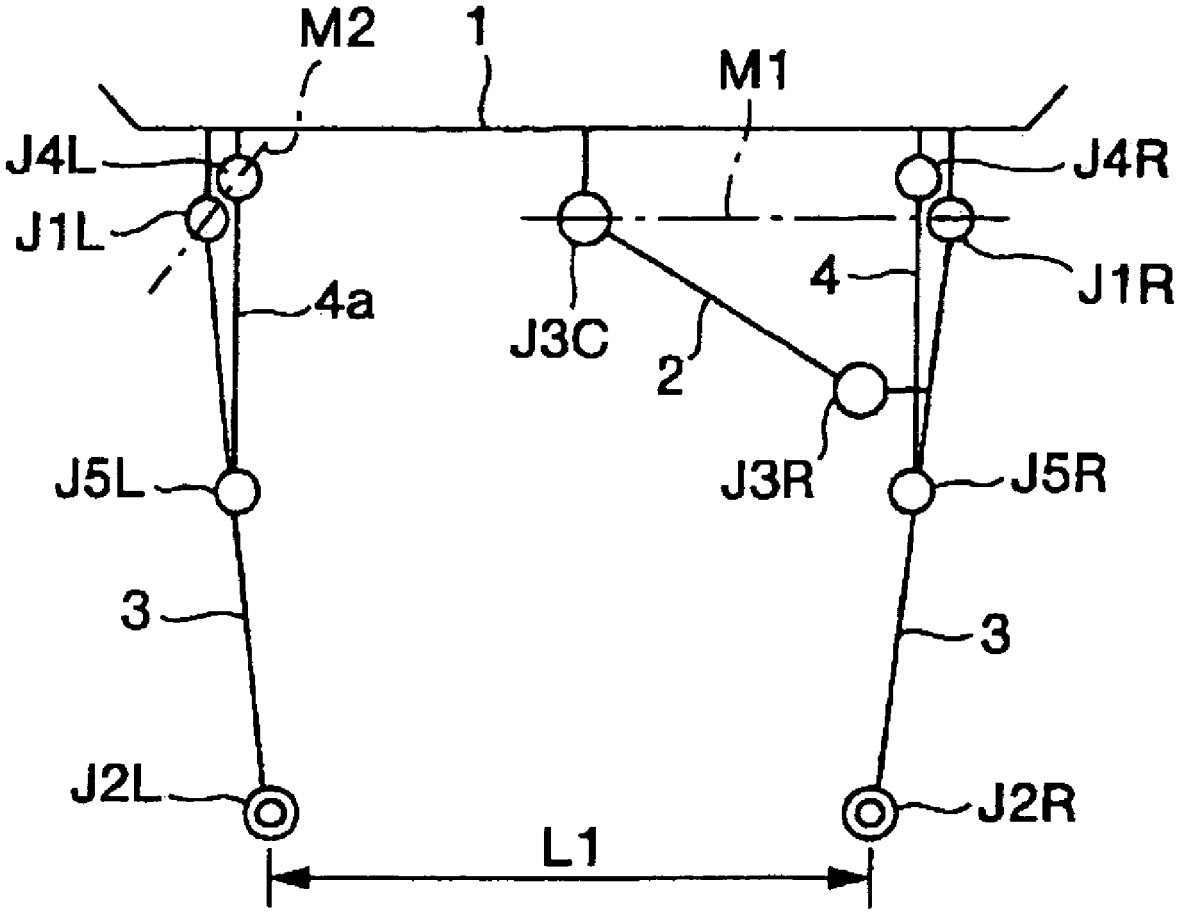
FIG. 2 is a skeleton plan diagram for explaining an operation of the present invention.
Figure 3:
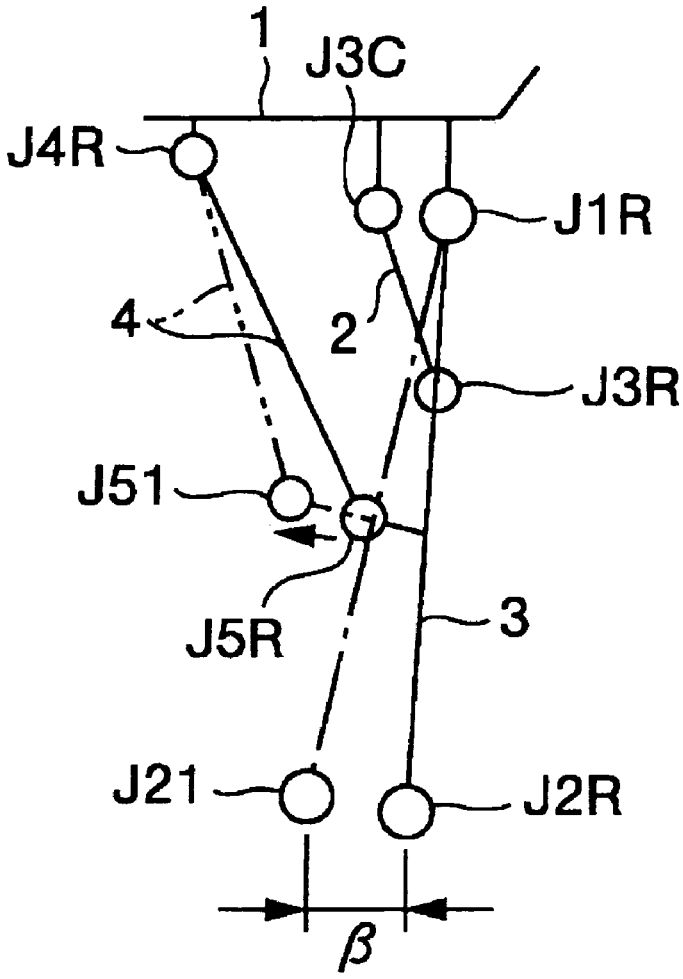
FIG. 3 is a skeleton right side diagram for explaining the operation of the present invention.
Figure 4:
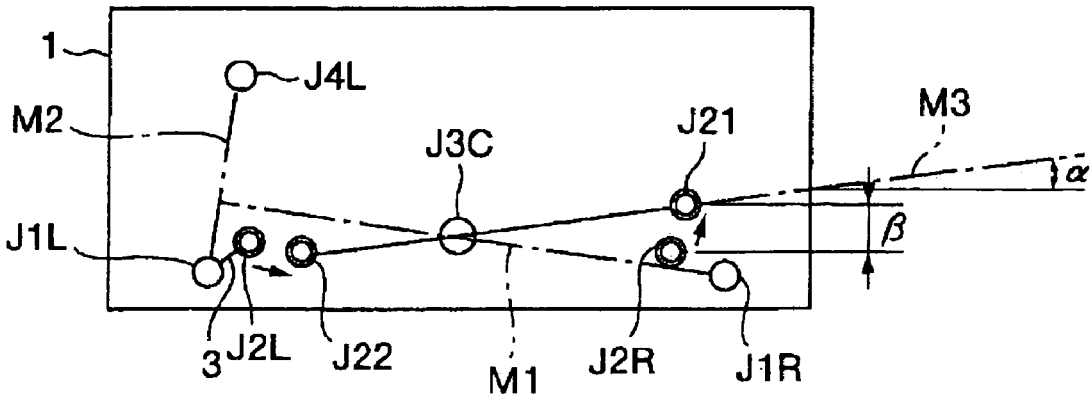
FIG. 4 is a skeleton diagram for explaining the operation of the present invention, and is a diagram of the blade seen from a back.

Next, based on FIG. 2 to FIG. 4, an operation of the blade with the above-described constitution will be explained. FIG. 2 to FIG. 4 are skeleton diagrams for explaining the operation, FIG. 2 is a plan diagram, FIG. 3 is a right side of FIG. 2, and FIG. 4 is a front diagram of FIG. 2 (diagram of the blade 1 seen from a back). Here, for explanation, a connecting portion such as a ball joint or a cross joint is called a connection point.

A case in which a tilt driving hydraulic cylinder 4 is contracted will be explained. The case is considered with the attitude of the blade 1 being fixed in a vertical state shown in FIGS. 2 and 3. When the tilt driving hydraulic cylinder 4 is contracted, as shown by the two-dot chain line in FIG. 3, a connection point J5R of the hydraulic cylinder 4 and the right straight frame 3 moves to an upper position of J51. Following this, a connection point of the right straight frame 3 with a. vehicle main body is moved to J21 away from J2R by a height β. As a result, the right straight frame 3 is rotated around a line M1 connecting connection points J1R and J3C as a center of rotation. In this situation, under the limiting condition that "length of each link (which is a general term for the blade 1, the straight frame 3, the arm 2, a support member 4*a* and the like), and a length L1 between a connection point J2L and the connection point J2R of a set of left and right straight frames 3 and 3 and the vehicle main body are fixed", each link is moved. Consequently, as shown in FIG. 4, the left straight frame 3 to which the support member 4*a* is connected is rotated around a line M2 connecting connection points J1L and J4L as a center of rotation, and the connection point J2L of the left straight frame 3 and the vehicle main body is moved to J22. As a result, when the attitude of the blade 1 is looked at again with a line M3 connecting the connection points J21 and J22 of the straight frames 3 and 3 and the vehicle main body as a reference (namely, fixed in a horizontal state), the blade 1 is tilted by a predetermined angle α with a right side facing down. Namely, by contracting the tilt driving hydraulic cylinder 4, the blade 1 is tilted so that the right side faces down.

In order to equalize tilt amounts to the left and right with the horizontal state of the blade 1 as the reference, a position of the connection point J3C of the one arm 2 on the blade side is provided at an upper position from a line connecting the connection points J1L and J1R of the set of left and right straight frames 3 and 3 on the blade side.

Figure 5:
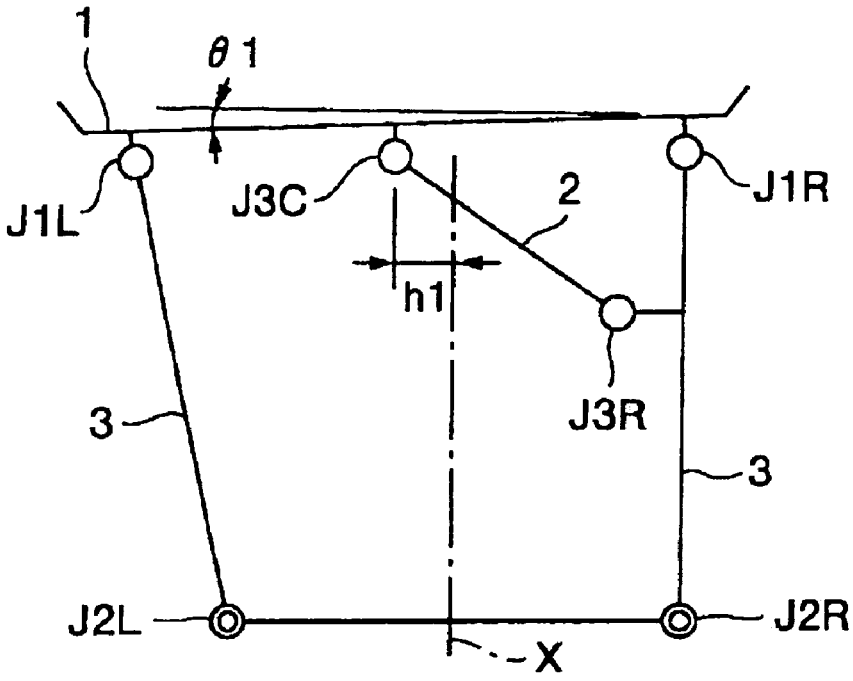
FIG. 5 is a skeleton diagram for explaining the operation of the present invention, and shows an off-set state of the blade to a left side.

In the above-described constitution, a little angle action is performed following the tilt action. Namely, when the tilt driving hydraulic cylinder 4 is contracted, the connection point J3C is off-set to the left side from a center line between the connection points J21 and J22 of the set of left and right straight frames 3 and 3 and the vehicle main body, as understood from FIG. 4. FIG. 5 shows this state. The connection point J3C is off-set to the left side by h1 with respect to a vehicle body center line X in a longitudinal direction, and thus the blade 1 is correspondingly inclined (hereinafter, called the angle action) by a predetermined angle θ1 to be in the attitude with a left end portion being displaced rearward with respect to a right end portion in the plan view. On the other hand, when the tilt driving hydraulic cylinder 4 is extended, the connection point J3C is off-set to the right side with respect to the vehicle body center line X, and the blade 1 performs the angle action by a predetermined angle θ2 to be in the attitude with the right end portion being displaced rearward with respect to the left end portion in the plan view.

Figure 6:
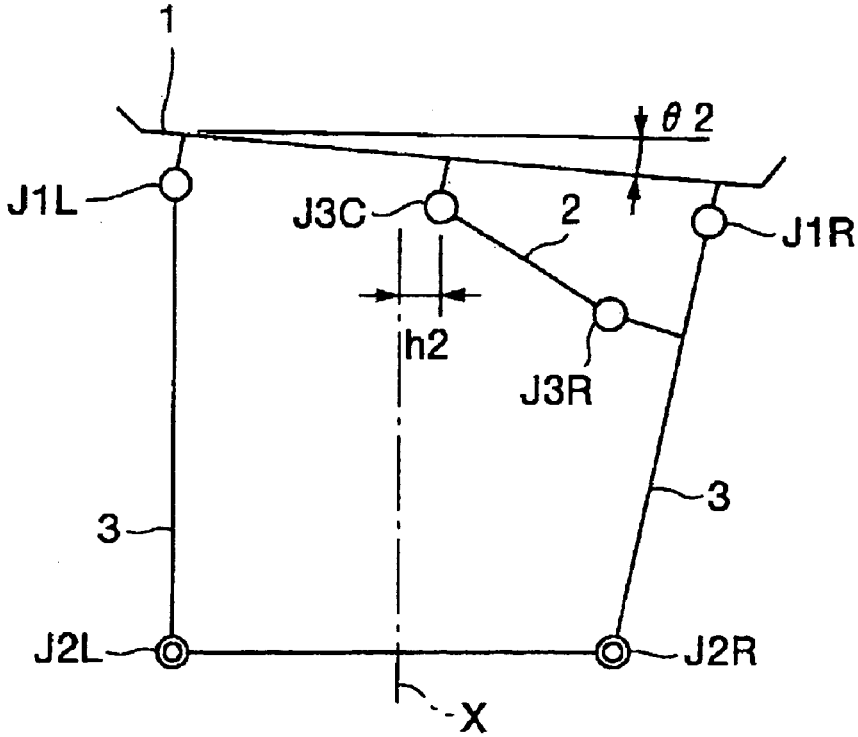
FIG. 6 is a skeleton diagram for explaining an operation of the present invention, and shows an off-set state of the blade to a right side.
Figure 7:
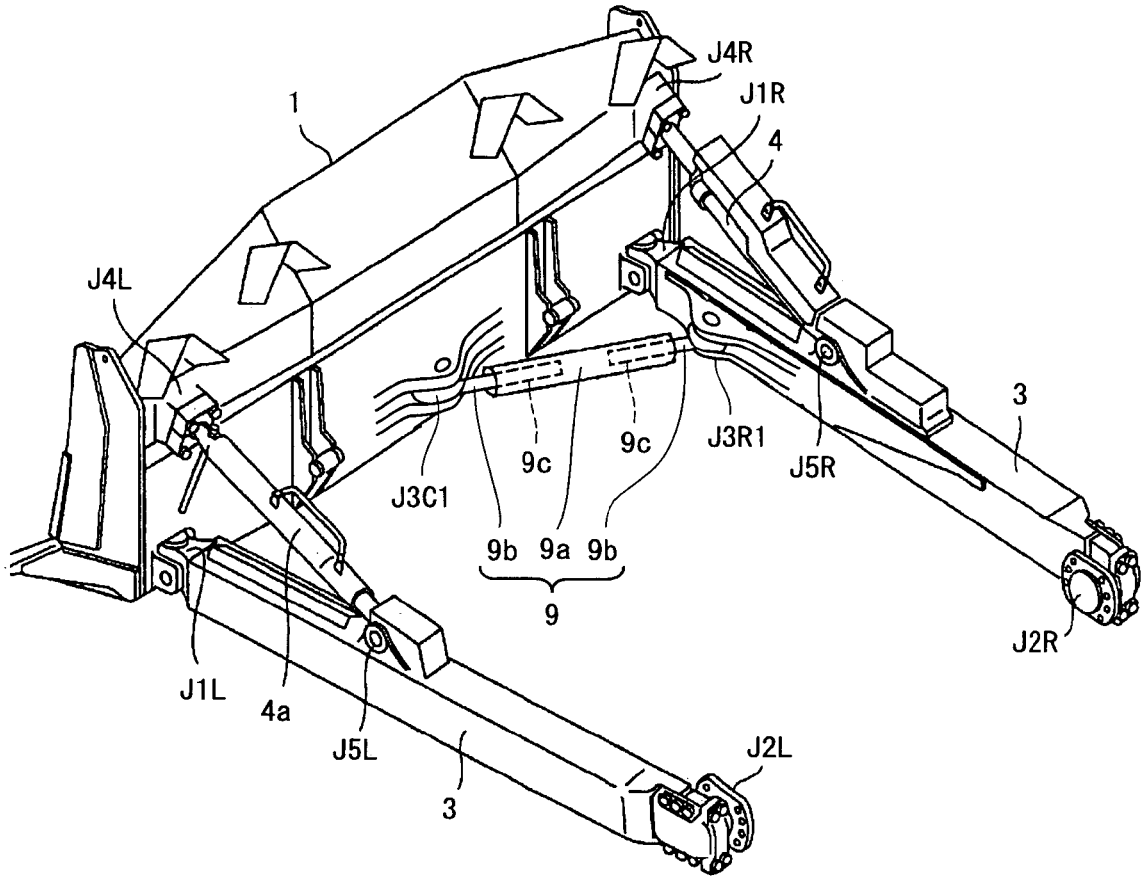
FIG. 7 is an explanatory view of another arm constitution according to the embodiment.

In the above-described embodiment, the length of the one arm 2 is fixed, but this is not restrictive. For example, the length of the arm 2 is constituted to be variable, whereby the angling angle θ can be changed, and the bulldozer can be used as an angledozer. In this case, the arm 2 may be constituted of, for example, an extendable and contractible actuator (for example, the hydraulic cylinder 4 in FIG. 1) such as a hydraulic cylinder. Further, the arm may be an arm 9 which is constituted of connecting members 9*b*, 9*a* and 9*b* of which length is made variable by changing fastening positions by screws 9*c* and 9*c*, as shown in FIG. 7. In the arm 9, the connecting member 9*b* at the left side is connected to the blade 1 via a universal joint (for example, a ball joint or the like) J3C1, and the connecting member 9*b* at the right side is connected to the straight frame 3 via a pin joint J3R1. The pin joint J3R1 may be a ball joint. The length of the arm 2 shown in FIG. 5 is set to be longer than the length of the arm 2 shown in FIG. 6, and the longer the length of the arm 2, the smaller the angling angle θ with respect to the same tilt amount (tilt angle α) According to the present invention, the following effect is provided. The one arm 2 for connecting the central lower portion of the blade 1 and the straight frame 3 is provided at only one side of any one of the left and the right straight frames 3 and 3, and the rigidity (namely, the attitude) of the blade 1 with respect to the external force from the left and right direction is held by the arm 2. In this situation, the arm 2 is connected to the blade 1 via the connecting member such as the ball joint J3C without bypassing the link member 5 which is conventionally used. Since this makes the location of the blade 1 nearer to the vehicle main body by the length of the link member 5 as compared with the prior art, a pressing force of the blade 1 is exhibited efficiently to make it possible to enhance the working performance, and the weight balance of the entire vehicle is improved to make it possible to enhance the traveling performance. Further, since the blade 1 is located nearer to the vehicle body, visibility can be increased.

Since the arm 2 can be located nearer to the blade 1 by the length of the link member 5 which is eliminated, visibility of the blade 1 can be easily secured. Since the arm does not exist at the end portion of the blade 1 at the side opposite to the mounting side of the one arm 2, visibility of the blade 1 can be more increased. Especially by providing the arm 2 at the side far from the driver's seat provided at the side of the vehicle body, the visibility of the blade end portion at the side near thereto can be improved. As a result of them, blade operability during a ground leveling operation can be enhanced. Further, since the number of the arm 2 is only one, the welded spots of the connecting portions are decreased, thus making it possible to reduce manufacturing cost and reduce the entire weight including the blade peripheral components. Further, since the number of grease supplying spots at the connecting portion is small, and therefore the grease supplying operation can be easily performed.

The arm 2 is connected to only one side of either the left or right of the blade 1, whereby the rigidity distribution of the mounting structure of the blade 1 can be concentrated to the mounting side of the arm 2. Consequently, the base material strength distribution for welding can be concentrated on one side, and therefore reduction in the entire weight including the blade peripheral components can be achieved. Further, the load of the arm 2 for supporting lateral load does not act on the straight frame 3 to which the arm 2 is not connected, and therefore the reduction of the weight of the straight frame 3 and simplification of the structure thereof can be achieved.

The connection point J3C of the one arm 2 to the blade 1 is provided at the upper portion from the line connecting the connection points J1L and J1R of the set of left and right straight frames 3 and 3 and the blade 1. Further, the rotation axis of the straight frame 3 at the right side, namely, the line M1 connecting the connection points J1R and J3C is made to intersect the rotation axis of the straight frame 3 at the left side, namely, the line M2, which connects the connection points J1L and J4L, at the substantially right angle, whereby the left and right tilt amounts can be equalized. This makes it possible to enhance the tilt operability and enlarge the application range of this bulldozer.

The one arm 2 is constituted to be variable in length with the hydraulic cylinder or the like, whereby the angling angle of the blade 1 can be changed, thus making it possible to use the bulldozer as an angledozer. Further, if the length of the arm 2 is constituted to be variable, it is also possible to off-set the blade 1 in the left and right direction. Due to them, mole-plowing, and earth moving operation to a valley at an edge of a precipice can be facilitated, and the application range of the bulldozer can be enlarged.

In the embodiment, the explanation is made with the constitution example of a so-called single tilt, which is provided with the tilt driving hydraulic cylinder 4 at only one side of either left or right side, but the present invention is not limited to this constitution, and the present invention may be with the constitution provided with the hydraulic cylinders 4 at both left and right sides. The connecting member is not limited only to the ball joint, but it may be suitable if it is a joint swingable up and down and to the left and right, and it may be, for example, a cross joint or the like.

What is claimed is:

1. A blade mounting structure of a bulldozer, comprising:

a set of left and right straight frames which swingably connect a left portion and a right portion of a blade and a vehicle main body, wherein only a single one of the left and right straight frames has an additional connection to the blade at a center position of the blade that is equidistant between two sides of the blade in a lengthwise direction thereof; and a single arm to provide said additional connection between said single one of said set of left and right straight frames and said blade;

wherein said single arm is swingable up and down and to a left direction and a right direction via a universal joint connecting said single arm to said blade.

2. The blade mounting structure of a bulldozer according to claim 1, wherein said arm has a variable length.

3. The blade mounting structure of a bulldozer according to claim 1, wherein a connecting point of said arm and said blade is provided at an upper portion with respect to a line connecting connection points of said set of left and right straight frames and said blade.

4. The blade mounting structure of a bulldozer according to claim 3, wherein said arm has a variable length.

5. The blade mounting structure of the bulldozer according to claim 1, wherein a hydraulic cylinder for tilt drive and a support member swingably connect the set of left and right straight frames to the blade.

6. The blade mounting structure of the bulldozer according to claim 1, wherein a set of left and right hydraulic cylinders for tilt drive swingably connect the set of left and right straight frames to the blade.

7. A blade mounting structure of a bulldozer, comprising:

a set of left and right straight frames which swingably connect a left portion and a right portion of a blade and a vehicle main body;

wherein only a single one of the set of left and right straight frames is additionally connected to the blade at a center position of the blade that is equidistant between two sides of the blade in a lengthwise direction thereof; and wherein said single one of the set of left and right straight frames is connected to the blade to be swingable up and down and to a left direction and a right direction by a connecting member which consists of a single arm.

8. The blade mounting structure of a bulldozer according to claim 7, wherein said arm has a variable length.

9. The blade mounting structure of a bulldozer according to claim 7, wherein a connecting point of said arm and said blade is provided at an upper portion with respect to a line connecting connection points of said set of left and right straight frames and said blade.

10. The blade mounting structure of a bulldozer according to claim 9, wherein said arm has a variable length.

11. The blade mounting structure of the bulldozer according to claim 7, wherein a hydraulic cylinder for tilt drive and a support member swingably connect the set of left and right straight frames to the blade.

12. The blade mounting structure of the bulldozer according to claim 7, wherein a set of left and right hydraulic cylinders for tilt drive swingably connect the set of left and right straight frames to the blade.

* * * * *